United States Patent [19]

Niedermeyer

[11] 4,086,457

[45] Apr. 25, 1978

[54] FLOAT SWITCH SIGNALLING TWO DIFFERENT LIQUID LEVELS

[76] Inventor: Karl O. Niedermeyer, 17WO68 North St., Bensenville, Ill. 60106

[21] Appl. No.: 751,117

[22] Filed: Dec. 16, 1976

[51] Int. Cl.[2] ..... H01H 35/18

[52] U.S. Cl. ..... 200/84 R; 340/244 D; 73/322.5; 200/81.9 HG

[58] Field of Search ..... 16/DIG. 13; 340/244 B, 340/244 D; 200/81.4, 84 R, 61.2, 81.9 HG; 73/308, 317, 322.5

[56] References Cited

U.S. PATENT DOCUMENTS

| | | | |
|---|---|---|---|
| 2,600,659 | 6/1952 | Koch, Jr. | 340/244 D |
| 3,393,283 | 7/1968 | Lenning | 73/322.5 |
| 3,659,064 | 4/1972 | Inove | 73/322.5 |
| 3,662,131 | 5/1972 | Leistiko | 340/244 D |

FOREIGN PATENT DOCUMENTS

| | | | |
|---|---|---|---|
| 686,700 | 3/1965 | Italy | 16/DIG. 13 |
| 1,073,558 | 6/1967 | United Kingdom | 200/84 R |

*Primary Examiner*—Gerald P. Tolin
*Attorney, Agent, or Firm*—Darbo & Vandenburgh

[57] ABSTRACT

A plastic vessel forming a float is secured to one end of a plastic tube. The other end of the tube is fixedly mounted and intermediate the ends is a hinge section. Two mercury switches are positioned in the vessel at different angles of inclination with respect to the axis of the vessel so that as the vessel pivots about the hinge with variations in the level of the liquid upon which the vessel floats, the switches close at different positions of the float. The angle of inclination of one of the mercury switches is adjustable.

10 Claims, 3 Drawing Figures

FLOAT SWITCH SIGNALLING TWO DIFFERENT LIQUID LEVELS

BACKGROUND AND SUMMARY OF THE INVENTION

In various applications it is desired to detect two different liquid levels. For example, it may be required that a motor be turned on when the liquid is at one level and turned off when the liquid is at a second, lower level. Another example would be a situation which required one pump to be turned on when the liquid reached a first level and a second pump to be turned on when the liquid reached a second, higher level. An example of an apparatus of this character will be found in my prior U.S. Pat. No. 3,972,647. Conventionally, two separate level detecting devices are employed. Float switches are known for this purpose and the known float switches include one in which a mercury switch is embedded or otherwise incorporated into the float with the float being so mounted that its angle of inclination changes with a change in the level of the liquid. At a predetermined inclination, the mercury in the mercury switch reaches a pair of electrical contacts to close an electrical circuit, or leaves the contacts to open an electrical circuit.

In the present invention, two mercury switches are incorporated into a single float with the switches having different angles of inclination with respect to the axis of the float. Thus, as the angle of inclination of that axis varies with varying liquid levels the switches will be actuated (opened or closed) at points corresponding to different liquid levels. The inclination of one of the switches with respect to the axis of the float is adjustable whereby the difference in liquid levels which will cause actuation of the respective switches may be varied.

In addition to simplification and cost reduction in the cost of manufacture, a structure of this type has a number of advantages. One advantage that may be significant in many installations is the matter of saving of space. Many sumps, for example, are relatively small in horizontal cross-section as compared to the space required for the insertion of the pump mechanisms and their controls. This is particularly true where it is desired to utilize two pumps, one comprising a motor driven from the house electric circuit and the second utilizing a battery powered direct current motor. Some installations will be made where the second pump is also driven from the household light circuit, but employed as a backup in case the water inflow into the sump is greater than can be handled by the primary pump. With such installations it is often difficult to accommodate two float, mercury switches because of the lack of available space remaining after the pumps are placed in the sump. Another significant advantage is ease and time saving in making the installation. The single switch can be installed on the pump mechanism at the time it is manufactured and a few simple adjustments at the time of installation will result in detecting the two different liquid levels as desired.

Another feature of the present invention is the mounting of the float on the end of a plastic tube which has a cutaway portion so that the remainder of the tube at the cutaway area serves as a hinge permitting the float to move in a vertical plane normal to the surface of the liquid while restraining the float against other movement. The switches are positioned so that the movement in that plane results in the mercury moving toward or away from the electrical contacts of the switches. Not only does this construction provide repeatable performance in water level detection, but it is a very economical structure to manufacture.

Further objects and advantages will be apparent from the following description taken in conjunction with the drawings.

DESCRIPTION OF SPECIFIC EMBODIMENT

Figure 1:
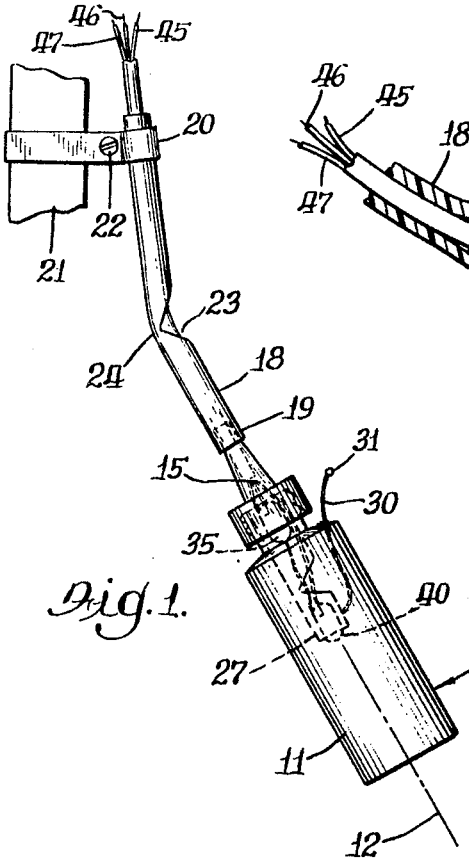
FIG. 1 is an elevational view of an embodiment of the invention as it would appear when initially installed on a sump pump, for example.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

In the illustrated embodiment there is a float in the form of a plastic vessel, generally 10. It comprises an annular wall 11 about a longitudinal axis 12, a base or closed end 13 and a neck 14. The vessel also includes a cap 15 threaded onto the neck and forming a fluid-tight seal therewith. The vessel defines an internal chamber 16.

The mount for the float comprises a plastic tube 18. End 19 of the tube is secured to cap 15 in a manner such that the interior of the tube communicates with the chamber 16 in a fluid-tight manner. At a point remote from end 19 the tube is fixedly mounted. In the illustrated embodiment this is done by a clamp 20 which is secured about the tube and is fixedly mounted. The illustrated embodiment shows clamp 20 clamped about a pipe 21 which is a part of a sump pump, as for example the draw pipe or discharge pipe of the pump. The clamping force is obtained by a bolt 22. Loosening this bolt and thus the clamping force, permits the clamp to be raised or lowered on pipe 21, or the tube 18 to be raised or lowered in the clamp, thus providing an adjustment as to how far down in the sump the float 10 is positioned. Intermediate this fixed support and end 19, the tube has a cutaway portion 23. This cutaway area provides a weakening of the tube so that the remaining portion 24 at that location serves as a hinge. The tube is positioned so that this hinge portion 24 permits relatively free movement of the float in a vertical plane, with the freedom of movement of the float in a direction other than that of the vertical plane being restricted.

Within the float is a plastic tubing having one end 26 fixedly held in the neck 14 of the vessel and the other end 27 projecting into chamber 16 in cantilever fashion. Intermediate its ends this tubing has a cutaway portion 28. Again, the remaining portion 29 where the tubing is cut away serves as a hinge. To bend end 27 about this hinge there is an operating member in the form of a flexible wire or string 30. One end of this operating member is secured to the top of end 27 of the tubing, with the wire or string extending through an opening in the vessel so that the other end is external thereof. This external end has a knob 31 to facilitate grasping it. An elastomeric gasket 32 fits snugly about the wire or string 30 and serves as a seal for the opening in the vessel. On the outside of the gasket is a clip 33 which frictionally engages the wire or string, but can be manually moved to a different location on the wire or string when it is desired to change the angle of inclination of end 27 of the tubing with respect to the axis 12 of the vessel. Since the material of the tubing is resilient and has a memory, the tubing will stay straight except to the extent it is pulled up by the wire or string 30, and will return toward the straight position when that pulling is relieved.

Within end 26 of the internal tubing is a mercury switch comprising a metal shell 35 having a glob of mercury 36 therein. An electrode or contact 37 extends through an insulator 38 in one end of the shell. A corresponding mercury switch is mounted in end 27 of the internal tubing. This second switch likewise includes a metal shell 40, a glob of mercury 41, an electrode 42 and an insulator 43.

The two mercury switches are parts of electrical circuit that also include easily flexible wires 45–48. Wire 45 is connected to electrode 42, wire 48 connects shells 35 and 40, wire 46 connects to electrode 37 and wire 47 connects to shell 35. Thus when the glob of mercury shorts shell 40 and electrode 42, it completes an electrical circuit which also includes wires 45 and 47. When glob of mercury 36 shorts shell 35 and electrode 37 it completes an electrical circuit which also includes wires 46 and 47.

OPERATION

Figure 2:
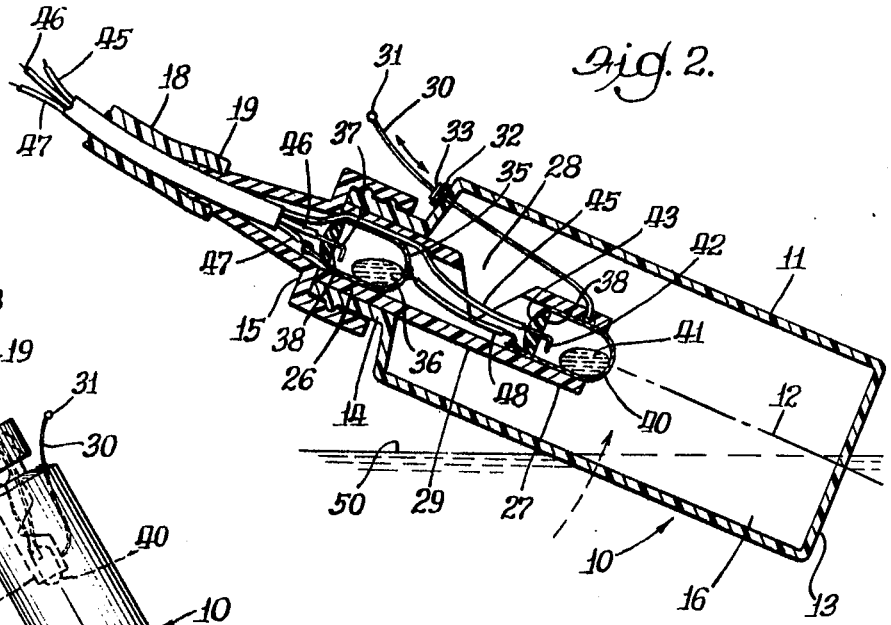
FIG. 2 is a longitudinal section through the embodiment of FIG. 1 when floating at a particular inclination on the surface of a body of liquid.
Figure 3:
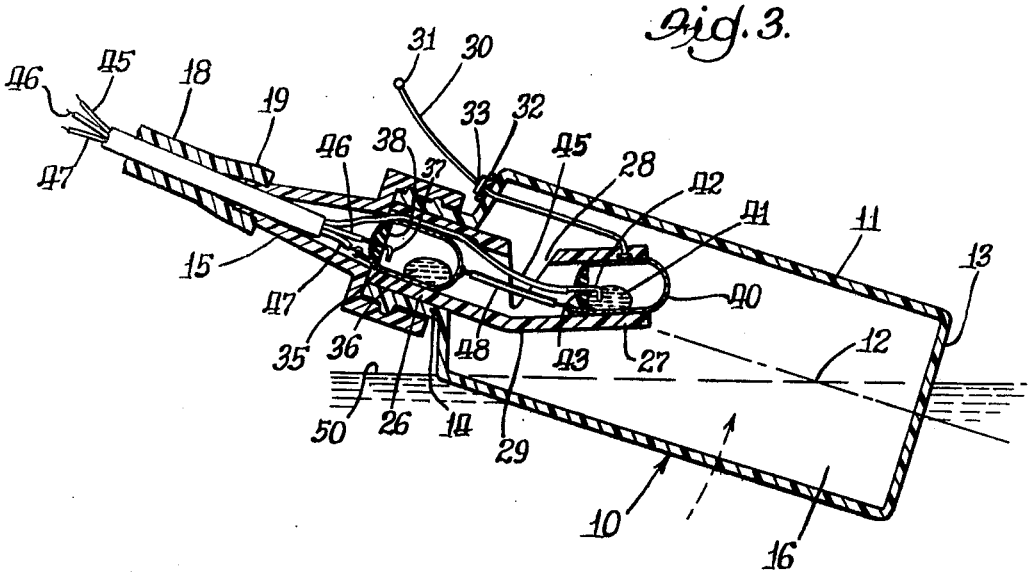
FIG. 3 is a view corresponding to FIG. 2 with an altered position of one of the mercury switches.

Normally, the two mercury switches would be positioned at different angles of inclination with respect to axis 12 of the float in the manner shown in FIG. 3; however, for the purposes of facilitating an understanding of the operation, the switch 40–43 in FIG. 2 has substantially the same inclination as respects axis 12 as does the switch 35–38. In both of these Figures the surface 50 of the liquid has the same elevation (as respects mounting brackets 20–22) so that the angle of inclination of the float with respect to the liquid surface is the same.

With the liquid surface 50 below the float, the float will be hanging down from its mounting somewhat in the manner illustrated in FIG. 1. In this position, the globs of mercury are in the ends of the switches remote from the electrodes so that both switches are open. Now assume that the surface 50 of the liquid raises to the elevation illustrated in FIGS. 2 and 3. Tube 18 pivots about hinge 24. This changes the inclination of the axis 12 with respect to the horizontal. This change in inclination is insufficient to cause the glob of mercury 36 in the upper switch to reach contact 37. However, with the end 27 of the inner tubing 26–29 tipped upwardly about hinge 29 in the manner illustrated in FIG. 3, the glob of mercury 41 in the lower switch is moved over against contact 42 thereby closing that electrical circuit. Had the end 27 of the tubing not had as great a difference in inclination as compared to axis 12 (which situation is illustrated in FIG. 2) the float at this position would not have caused the closing of the circuit which includes switch 40–43. With a further increase in the level of the surface 50 of the liquid, the inclination of axis 12 will decrease to the point at which the glob of mercury 36 ultimately will move over against contact 37 closing that contact. Thus by adjusting the angle of inclination of switch 40–43 with respect to axis 12 of the float the difference between the water levels that actuate the two switches may be changed.

The installation of the apparatus might be as follows. With the bolt 22 loose, the clamp 20 is raised or lowered on pipe 21 until an elevation is achieved at which a liquid level would raise the float sufficiently so that switch 35–38 would close. Bolt 22 is then tightened. Then the angle of inclination of switch 40–43 with respect to axis 12 is adjusted so as to establish the second, lower liquid level at which the switch 40–43 closes. This latter adjustment normally would be made starting from the position of tubing end 27 as illustrated in FIG. 2 and pulling on knob 31 to move end 27 of the tubing about hinge 29. When switch 40–43 had been thus moved to an inclination with respect to axis 12 at which that switch would close at the desired second, lower level, clip 33 would be slid along wire or string 30 until it abutted gasket 32. With the clip frictionally engaging the wire or string 30 and simultaneously abutting gasket 32 the desired inclination of end 27 of the tubing would be fixed (as for example in the position illustrated in FIG. 3). Should it be desired to decrease the angle of inclination of switch 40–43 with respect to axis 12, clip 33 is slid toward knob 31 sufficiently to allow the memory of the material of the tubing to turn it back towards the position illustrated in FIG. 2.

An example of a complete electrical circuit with which the present invention might be employed is found in my application entitled Air Pressure Switch Signaling Two Different Pressure Conditions filed concurrently herewith, the disclosure of which is incorporated herein by reference.

In the illustrated embodiment the mercury switches are arranged so as to close an electrical circuit with an increase in the level of the surface 50 of the liquid. Were it desired to open an electrical circuit under such conditions, the respective mercury switch would be reversed end for end in the inner tube so that the glob of mercury therein would leave the respective electrode upon the surface of the liquid raising to the level which it was desired to detect.

Embodiments of the invention can be employed to detect "low" levels of liquid in a vessel as an alternative to detecting "high" levels as described above. For example, were the described embodiment mounted so that the float were a short distance above the bottom of a vessel filled with liquid, the float would project upwardly from hinge 24 to the extent permitted by that hinge. This would result in both switches being closed (or open if the alternative of the preceding paragraph were employed). When the liquid level dropped to an extent such that the float was approaching the position illustrated in FIG. 3, the mercury glob 36 would move away from contact 37 thus signaling a first low-liquid-level condition. A further reduction in the liquid level would result in mercury glob 41 leaving contact 42 thus signaling a second, lower liquid-level condition.

The present invention is easily employed for the detection of a number, greater than two, of liquid-level conditions. For example if the number were three, the tube 26–29 would be extended by adding an additional hinge portion (corresponding to 29) onto the end of the illustrated portion 27 followed by an additional end portion (corresponding to 27) with a third mercury switch in the additional end portion. Additional wires (corresponding to 45 and 48) would connect to the third mercury switch. The string or wire 30 would connect to the additional end portion and when tightened would result in the deflection of both hinges so that all three switches would be at different inclinations to axis 12 of the float. Thus each would signal a different liquid level condition.

I claim:

1. In a float switch apparatus for use with a body of liquid having an exposed surface, which apparatus includes a float having an end and defining an axis intersecting said end, means for mounting said float and attached to said end so that, when the float is at said surface, the inclination of the float axis varies as the level of said surface varies, and electrical circuit means including a mercury switch secured to the float and positioned at a given angle with respect to said axis whereby an electrical circuit formed by said circuit means changes condition between open and closed at a given inclination of the float, the further improvement wherein:

said electrical circuit means including a second electrical circuit having a second mercury switch therein, said second mercury switch being secured to said float and positioned at another angle with respect to said axis to change the condition of said second electrical circuit between open and closed at an inclination of said float different than said given inclination at which the condition of the first mentioned electrical circuit changes.

2. In an apparatus as set forth in claim 1, including means connected to said float and said second mercury switch for adjusting the inclination of said second mercury switch with respect to the inclination of the first mentioned mercury switch whereby the difference in inclinations at which the conditions of said two circuits are changed may be varied.

3. In an apparatus as set forth in claim 2, wherein said float comprises walls forming a vessel having an internal chamber, said mercury switches being positioned in said chamber, the last mentioned means including a hinge support connecting the vessel and the second mercury switch and an operating member connected to said support and having an operating member external of said vessel.

4. In an apparatus as set forth in claim 3, wherein said mounting means restricts movement of said float substantially to a plane normal to said surface, said mercury switches being mounted so that movement thereof in said plane will cause said change in condition of the respective circuits.

5. In an apparatus as set forth in claim 4, wherein said mounting means includes a flexible tube having two ends, said tube being secured to said float adjacent one of said ends with said one end being in communication with said chamber, said mounting means immovably securing a part of said tube, said part being remote from said one end with a portion of said tube therebetween, said portion of said tube having an opening in said plane thereby weakening said tube at said opening so that the remainder of the tube acts as a hinge, said circuit means including easily flexible wires extending through said tube.

6. In an apparatus as set forth in claim 5, including a flexible tubing in said chamber, said tubing having two ends with a hinge portion intermediate said ends, one of said ends being immovably secured to said vessel with the remainder of the tubing being cantilevered from said one end, one of said switches being secured in said tubing at one side of said hinge portion and the other of said switches being secured in said tubing at the other side of said hinge portion, said operation member being connected to said tubing at said other side of said hinge portion.

7. In an apparatus as set forth in claim 3, including a flexible tubing in said chamber, said tubing having two ends with a hinge portion intermediate said ends, one of said ends being immovably secured to said vessel with the remainder of the tubing being cantilevered from said one end, one of said switches being secured in said tubing at one side of said hinge portion and the other of said switches being secured in said tubing at the other side of said hinge portion, said operation member being connected to said tubing at said other side of said hinge portion.

8. In an apparatus as set forth in claim 1, wherein said mounting means restricts movement of said float substantially to a plane normal to said surface, said mercury switches being mounted so that movement thereof in said plane will cause said change in condition of the respective circuits.

9. In an apparatus as set forth in claim 8, wherein said mounting means includes a flexible tube having two ends, said tube being secured to said float adjacent one of said ends with said one end being in communication with said chamber, said mounting means immovably securing a part of said tube, said part being remote from said one end with a portion of said tube therebetween, said portion of said tube having an opening in said plane thereby weakening said tube at said opening so that the remainder of the tube acts as a hinge, said circuit means including easily flexible wires extending through said tube.

10. In a float switch apparatus for use with a body of liquid having an exposed surface, which apparatus includes a float defining an internal chamber, means for mounting said float so that, when the float is at said surface, the inclination of the float varies as the level of said surface varies, and electrical circuit means including a mercury switch secured to the float whereby an electrical circuit formed by said circuit means changes condition between open and closed at a given inclination of the float, the further improvement wherein:

said mounting means includes a flexible tube having two ends, said tube being secured to said float adjacent one of said ends with said one end being in communication with said chamber, said mounting means immovably securing a part of said tube and holding said tube so that as the tube moves in a vertical plane a first side of the tube will be uppermost and a second side of the tube will be lowermost, said part being remote from said one end with a portion of said tube therebetween, said portion of said tube having an opening in one of said sides thereby weakening said tube at said opening so that the remainder of the tube acts as a hinge with the hinge permitting relatively easy movement of the float in said plane and less easy movement of the float away from the plane, said circuit means including easily flexible wires extending through said tube.

* * * * *